US008341913B2

(12) United States Patent
Meres et al.

(10) Patent No.: US 8,341,913 B2
(45) Date of Patent: Jan. 1, 2013

(54) CEILING SUSPENSION SYSTEM

(75) Inventors: Oskar Meres, Vallensbaek Strand (DK); Michael Bjorn Hansen, Hvidovre (DK)

(73) Assignee: Rockwool International A/S, Hedehusene (DK)

( * ) Notice: Subject to any disclaimer, the term of this patent is extended or adjusted under 35 U.S.C. 154(b) by 417 days.

(21) Appl. No.: 12/521,193

(22) PCT Filed: Dec. 11, 2007

(86) PCT No.: PCT/EP2007/010802

§ 371 (c)(1), (2), (4) Date: Oct. 9, 2009

(87) PCT Pub. No.: WO2008/077480

PCT Pub. Date: Jul. 3, 2008

(65) Prior Publication Data

US 2010/0095627 A1 Apr. 22, 2010

(30) Foreign Application Priority Data

Dec. 27, 2006 (EP) ..... 06256590
Aug. 2, 2007 (GB) ..... 0715051.9

(51) Int. Cl.

| | |
|---|---|
| ***E04C 2/52*** | (2006.01) |
| ***E04B 2/30*** | (2006.01) |
| ***E04B 2/00*** | (2006.01) |
| ***E04B 5/00*** | (2006.01) |
| ***E04B 5/10*** | (2006.01) |
| ***E04H 12/00*** | (2006.01) |

(52) U.S. Cl. ..... 52/506.06; 52/220.6; 52/489.1; 52/506.07; 52/647; 52/655.1

(58) Field of Classification Search ..... 52/220.6, 52/483.1, 489.1, 506.06, 506.07, 506.08, 52/506.09, 506.01, 647, 650.3, 655.1
See application file for complete search history.

(56) References Cited

U.S. PATENT DOCUMENTS 2,307,653 A * 1/1943 Wright ..... 52/506.06
(Continued)

FOREIGN PATENT DOCUMENTS

AU 5656465 A 9/1967
(Continued)

OTHER PUBLICATIONS

European Patent Office, International Search Report in Application No. PCT/EP2007/010802, dated Aug. 20, 2008.

*Primary Examiner* — Joshua J Michener
*Assistant Examiner* — Ryan Kwiecinski
(74) *Attorney, Agent, or Firm* — McAndrews, Held & Malloy, Ltd.

(57) ABSTRACT

The invention relates to a system for suspending ceiling tiles, comprising a plurality of substantially parallel upper supports, a plurality of substantially parallel lower supports which are substantially perpendicular to the upper supports and which cross the upper supports at crossing points, the upper supports having apertures and being suspended via suspending means, a mounting clip which affixes each lower support to an upper support at a crossing point, the lower supports each having a substantially vertical web, wherein the mounting clip has the form of two plates each having an upper section and a lower section and the upper section of each plate has a protruding section at one edge, and the two protruding sections each pass through an aperture in the upper support, whereby the lower sections of the two plates pass on opposite sides of the vertical web of the lower support and press against and grip the lower support as a result of the protruding sections being held within the aperture or apertures in the upper support. It also relates to a method for mounting ceiling tiles using this system, a novel mounting clip and a novel stop clip for use in the system and method.

22 Claims, 16 Drawing Sheets

U.S. PATENT DOCUMENTS

| | | | | | |
|---|---|---|---|---|---|
| 3,139,162 | A | * | 6/1964 | Spangenberg | 52/506.08 |
| 3,390,856 | A | * | 7/1968 | Van Buren, Jr. | 248/317 |
| 3,594,970 | A | * | 7/1971 | MacGrath et al. | 52/506.07 |
| 3,708,941 | A | * | 1/1973 | Cuckson | 52/506.08 |
| 4,726,165 | A | * | 2/1988 | Brinsa | 52/665 |
| 4,858,408 | A | * | 8/1989 | Dunn | 52/506.07 |
| 6,811,130 | B1 | * | 11/2004 | Oh | 248/343 |
| 7,240,884 | B2 | * | 7/2007 | Shim | 248/342 |
| 2004/0118068 | A1 | * | 6/2004 | Kliegle et al. | 52/483.1 |
| 2008/0060306 | A1 | * | 3/2008 | Platt et al. | 52/506.06 |
| 2010/0050554 | A1 | * | 3/2010 | Ahren et al. | 52/506.06 |

FOREIGN PATENT DOCUMENTS

| | | | | |
|---|---|---|---|---|
| DE | 1199957 | B | | 9/1965 |
| DE | 3606127 | A1 | | 4/1987 |
| DE | 29600514 | U1 | | 7/1996 |
| EP | 1083340 | A2 | | 3/2001 |
| GB | 658481 | A | | 10/1951 |
| GB | 2152090 | A | * | 7/1985 |
| JP | 06073832 | A | * | 3/1994 |
| JP | 06240804 | A | * | 8/1994 |
| NL | 6902949 | A | | 8/1970 |
| WO | WO2006099753 | A | | 9/2006 |

* cited by examiner

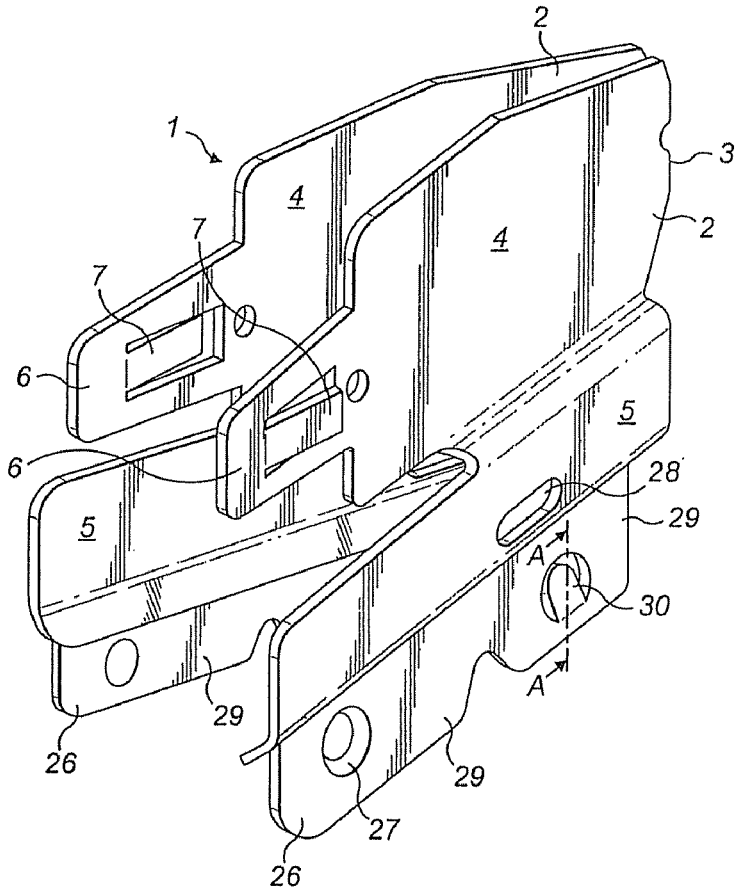
FIG. 10a
Fig.10b.
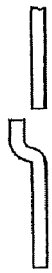

CEILING SUSPENSION SYSTEM

RELATED APPLICATION

This application is a 371 National Phase filing of International Patent Application Serial No. PCT/EP2007/010802 filed Dec. 11, 2007, which claims priority benefit of EP Patent Application Serial No. 06256590.8 filed Dec. 27, 2006 and Great Britain Patent Application Serial No. 0715051.9 filed Aug. 2, 2007. The above-referenced applications are incorporated herein by reference in their entirety.

FIELD OF THE INVENTION

The invention relates to a system for suspending ceiling tiles, and a method of assembling such a system, including fixing ceiling tiles. The invention also relates to a mounting clip suitable for use in the suspension system and a method of making this clip. The invention also relates to a novel stop clip suitable for use as part of this system and to a method of making such a stop clip.

BACKGROUND OF THE INVENTION

It is well known to provide grid systems for suspending ceiling tiles, to form a suspended ceiling. Such systems commonly include two sets of runners or supports, positioned mutually perpendicularly. One set of mutually parallel supports is suspended from the building ceiling and a set of mutually parallel supports is fixed perpendicular to these. One of these sets of supports forms the support for the ceiling tiles. The invention is concerned with systems in which there are upper supports which are mutually parallel and are suspended from the building ceiling, and lower supports affixed to these upper supports and which are perpendicular to the upper supports, and which act as supports for the ceiling tiles.

In such a system it is critical that stability of the grid formed is maintained, in particular that the distance between the supports in each parallel set is consistent and is maintained. It is also important that a system be provided in which the ceiling tiles themselves are securely positioned and do not shift easily once installed.

It is desirable to provide a system in which installation is convenient. It is also desirable to provide a system which is economical to provide and operate. It is particularly desirable to achieve all of these objects in the context of a grid system in which the supports themselves are intended to be invisible from below.

Various systems are already known for suspending ceiling tiles, including those where the support grid is concealed by the tiles.

One such system is available from USG, under the trade name DONN VM-DX. In this system one mutually parallel set of upper supports is suspended from the building ceiling and a second mutually parallel set of lower supports, perpendicular to the upper set, is provided on which the ceiling tiles are supported. A clip system is provided which fixes the lower set of supports to the upper set of supports. This clip system can only be affixed to the upper supports by means of a screw or other fastening element passed through the mounting clip and the upper support. Consequently this is rather difficult and time consuming to install. Furthermore, the rigidity of the grid system thus provided is not as good as would be desired.

A further commercially available system is the Focus D system, available from Ecophon. This is slightly different, in that a mutually parallel set of supports is suspended from the building ceiling, and it is these supports which support the ceiling tiles. Mutual separation is maintained between these supports by the use of V-profiles as upper runners which maintain the spacing between the supports. A fastening means is provided to maintain the V-profiles in position relative to the lower supports. A similar system is described in EP-A-1154088.

This system has the disadvantage of being rather time consuming and complicated to install and requires two different types of runner.

JP-A-55/138536 discloses a system which concerns provision of false ceilings, and involves mutually perpendicular upper and lower runners. The runners do not contain any apertures.

SUMMARY OF THE INVENTION

According to the invention we provide a system for suspending ceiling tiles, comprising a plurality of substantially parallel upper supports, a plurality of substantially parallel lower supports which are substantially perpendicular to the upper supports and which cross the upper supports at crossing points, the upper supports having apertures and being suspended via suspending means, a mounting clip which affixes each lower support to an upper support at a crossing point, the lower supports each having a substantially vertical web, wherein the mounting clip has the form of two plates each having an upper section and a lower section and the upper section of each plate has a protruding section at one edge, and the two protruding sections each pass through an aperture in the upper support, whereby the lower sections of the two plates pass on opposite sides of the vertical web of the lower support and press against and grip the lower support as a result of the protruding sections being held within the aperture or apertures in the upper support.

As a result of using this system, the upper and lower supports are affixed in a secure and rigid manner. The configuration of the mounting clip makes the system as a whole easy to install. It is also, with this system, possible to use upper and lower supports which are of essentially the same form. In particular, it is possible to apply this system using upper and lower supports which are in the form of standard invert T-profiles. This makes the system particularly economical.

It is also possible to use the system in combination with a standard stop clip, which allows easy removal and replacement of individual ceiling tiles with little risk of other tiles in the grid shifting out of place.

The mounting clip is itself novel and the invention also provides a mounting clip for use in fixing supports for a suspended ceiling in mutually perpendicular relationship, which is unitary and has the form of two plates each having an upper section and a lower section and the upper section of each plate has a protruding region at one edge, whereby the upper sections of the two plates are joined at a fold which is either at the top edges of the upper sections or at the side edges opposite those from which the protruding regions protrude, and the mounting clip is formed from material which renders it capable of being folded.

Also provided is a method of making such a mounting clip comprising providing a sheet of metallic material, punching from the sheet a blank having a predetermined shape, and folding the blank to form the mounting clip.

DETAILED DESCRIPTION OF THE INVENTION

Usually all upper supports are alike and all lower supports are alike.

The system of the invention can be effected with various forms of upper and lower support, provided that the upper support has apertures into which the protrusions in the upper section of the plates can pass and thereby be held.

However, one advantage of the invention is that the system is effective when either the upper or lower supports or both are, independently, in the form of an invert T-profile. Preferably both upper and lower supports are in the form of an invert T-profile.

Generally, the upper support has a substantially vertical web in which the apertures are positioned. This is generally the web of an invert T-profile.

Such invert T-profiles are of well-known general construction and are produced in large quantities, making the system of the invention particularly economical to operate. Supports of this kind are generally made of a strip of metal which is folded to form the web of the T-profile and flanges at one edge of the web. As is conventional for such T-profiles, the folding usually generates a hollow bulb at the opposite edge of the web from the flanges.

It is normal for apertures to be provided at regular intervals along the portion of the web which is between this bulb and the flanges, and it is normal practice for these intervals to be defined extremely precisely during manufacture. These apertures may be of any appropriate shape. Normally they are in the form of substantially vertical slots.

Each of the protruding regions passes through an aperture. Depending upon the configuration of the upper support, it can be possible for the two protruding regions each to pass through a separate aperture. Normally this requires the apertures to be close together.

Preferably, however, the two protruding regions pass through a single aperture in the upper support. In this way they are normally held in contact with one another.

Often the protruding regions are each substantially planar and are held substantially flush with one another.

Preferably the protruding sections from the upper section of the plates have barbs which prevent these sections from passing out of the aperture once fitted into it.

Preferably the fixing of the protrusions into the aperture or apertures in the upper support causes the upper sections of the plate to be in contact with one another. However, this is not necessary, provided that the arrangement is such that the lower sections press against and grip the lower support. Preferably the upper sections are substantially planar and are flush with one another when the protruding regions pass through the aperture or apertures.

It is also normal for further apertures to be provided in the bulb section of the web. It is normal manufacturing practice that these apertures are spaced at regular intervals, but the precision of the spacing is not as great as for the apertures in the portion of the web between the bulb and the flanges. These upper apertures are used, in the case of the upper support, to hold suspending means, such as hangers, in conventional fashion.

An advantage of the use of T-profiles is that they are made in large quantities and are, as a consequence, economically advantageous. They are made in slightly varying forms by different manufacturers, but each manufacturer provides a variety of invert T-profile supports having the same general shape, differing only in the length of the profile and the distance between the upper and lower apertures. They may also differ in the manner in which they are joined at their ends.

It is particularly preferred that the lower support has a substantially vertical web and, at its upper edge, a thicker section, such as a bulb in the case of a standard invert T-profile. This allows the plates of the mounting clip to be shaped so that the lower sections are able to grip along and under this thicker part.

Generally the lower sections of the plates of the mounting clip are each shaped so as to be able to correspond with any such thicker portion in the web of the lower support.

In a normal grid system for carrying a suspended ceiling, there are a plurality of upper supports and a plurality of lower supports substantially perpendicular to these. Generally there are at least three upper supports, often four or five or more, depending upon the area of the ceiling which is to be installed. Similarly, generally there are at least three and four or five and often more lower supports.

Thus, there will be a plurality of points at which the upper and lower supports cross. Preferably, there is a mounting clip applied at each crossing point. However, the security and rigidity of the connection provided by the invention is such that it is in some cases not necessary to provide a mounting clip at every crossing point. For instance, it may be necessary to apply a mounting clip only at alternate crossing points. The same applies if a single upper support is crossed by more than two lower supports.

The mounting clip is formed of two plates which are normally substantially planar. It is possible to provide a mounting clip in which the two plates are not connected, in the case where, when the protruding sections register with the aperture or apertures in the upper support, the two protruding sections are held in position, thus forcing the remainder of the two plates in contact with each other in their upper section and with the substantially vertical web of the lower support in their lower section.

However, best results and greatest convenience are obtained when the two plates form part of a unitary mounting clip having a single fold. The fold is in the upper section of the mounting clip. For instance the two upper edges of the plates may be joined. Preferably, however, the fold is substantially vertical, that is, the upper sections of the two plates are joined at their side edges opposite the protrusions which pass through the lower aperture in the upper support. This configuration assists in providing a reliable connection between the upper and lower supports.

Most preferably the mounting clip is unitary and is formed by folding a single sheet of material. The appropriate sheet can for instance be provided by punching out from a larger sheet. It may be made of any material having appropriate strength and malleability to allow folding and maintenance of the fold, but allowing manipulation of the mounting clip so that the two plates can be brought close to or in contact with one another in their upper sections and in the protruding sections.

As provided for use in the system of the invention, a mounting clip having a fold can be provided in a form such that the angle between the plates is from 180° to zero degrees, but is usually provided so that the angle between the two plates is in the range 5 to 140°, preferably in the range 10 to 50°, often about 10 to 30°. During installation, it is preferred to complete the fold and bring the upper section and the protrusions into contact with one another.

It is important that the mounting clip is made of a material which is sufficiently flexible to allow folding, as discussed above, but is at the same time sufficiently stiff that holding of the protruding regions in the aperture or apertures maintains the rest of the mounting clip, in particular the lower sections, in position.

Suitable materials include plastics and metals, in particular steel. The inventors have found that spring steel can be used, provided the thickness and stiffness of the plates is sufficiently high to retain their contact with the lower support when the protrusions are brought together in the aperture.

The fold joins the upper sections of the plates but it is important in the invention that they are not joined along the edges of the lower section, so that one plate can rest against each side of the substantially vertical web of the lower support, and be forced against it so as to provide a robust connection.

The plates may be connected along the entire length of the fold but preferably there is a break in the connection, to ease the process of bringing the plates close to or into contact with one another.

Preferably the lower section is shaped so as to correspond with the upper part of the vertical web of the lower support, in particular if this is in the form of a bulb. The lower section can then be shaped so as to extend around and under the bulb.

The width of the lower section can be chosen to maximise the stability of the connection between the upper and lower supports.

At the lower edge of the lower section of the plates there may be projections which are arranged so as to project towards the vertical web of the lower support. These projections can be arranged to register with apertures in the lower part of the vertical web of this support. This allows fixing of the position of the mounting clip, and hence fixing of the position of the upper support connected with the mounting clip.

It is also possible to include projections which are arranged to register with apertures in the bulb of the lower support. There can be any appropriate number of projections in the lower section, for instance up to three.

Registering these projections with these apertures has the advantage that their relative distances are very precisely defined and controlled by the manufacturers of invert T-profiles, which are the most preferred form for the lower support.

Alternatively, there may be apertures in the lower sections of the plates which can register with the apertures in the lower section of the vertical web of the lower support, and position can be maintained by passing a fastening means through the three registering apertures. This can be a wire, a screw or any other known form of clip.

Similarly, there may be apertures in the lower sections of the plates which can register with apertures in the bulb of the lower support. Any appropriate number of apertures may be provided in the lower section of the plates, for instance up to three. In a preferred embodiment there is one aperture in the upper part of the lower section and two apertures in the lower part of the lower section.

In a further preferred embodiment, there are two formations in the lower part of the lower section. One is an aperture and one is a hook. A hook is similar to an aperture in the plane of the lower part of the lower section but the material that has been removed from this plane to form the aperture is not removed from the clip entirely but is bent out of that plane to form a hook. The hook can protrude from the plane of the lower part of the lower section either towards the other plate or away from the other plate, but preferably protrudes towards to other plate.

It is possible to include both projections and apertures in a single plate.

If there is an aperture in one of the plates then there is preferably a corresponding aperture in the other plate, especially if the aperture registers with an aperture in the bulb of the lower support. If there is a projection in one of the plates then it is possible to have a corresponding projection in the other plate but this is not essential.

A variety of fastening means can be used to pass through registering apertures.

In one example the fastening means has a head and a barbed shaft which is pressed through the registering apertures and the barbs prevent the fastener from moving substantially once in the apertures. In this case the fastener is preferably made from a material which is deformable so that it can be inserted into the aperture but sufficiently rigid to maintain its position. Examples include polymeric materials.

In other examples the fastener may be such that it has a head and a shaft, the shaft being passed through the registering apertures and then extending some distance from the third aperture. It can then be bent, usually using a tool, so as to fix it in position in the aperture and prevent it falling out.

Preferably the lower sections are shaped so that at least a portion of each plate passes along the lower support and under the upper support.

Preferably the mounting clip is substantially symmetrical about the fold, so that the upper and lower sections of the two plates have essentially the same configuration. Thus, preferably the upper sections and protruding regions are substantially symmetrical about the fold. Independently, the lower sections may be symmetrical about the fold line. However, they may differ slightly in that the lower section of one plate may have a projection as discussed above, whereas the lower section of the other plate does not have such a projection.

According to the invention we also provide a method of fixing such a system. In this aspect, the invention provides a method of mounting a grid for a suspended ceiling, comprising (1) providing (A) an upper support which has a substantially vertical web containing at least one aperture and which is suspended from the building ceiling, (B) a lower support having a substantially vertical web, (C) a mounting clip having two plates, each plate having an upper section and a lower section, each upper section having at one side edge a protruding section, (2) placing the mounting clip over the lower support such that the lower sections of the plates are on opposite sides of the substantially vertical web of the lower support, (3) bringing the upper sections of the plates toward one another, and forcing the lower sections of the plates against the vertical web of the lower profile, (4) bringing each protruding section through an aperture provided in the vertical web of the upper support, so as to affix the lower and upper supports together in mutually perpendicular relationship.

It is possible to secure the ends of the upper and lower supports to the walls of the relevant room. This can be done in standard manner, for instance by means of brackets.

Generally the grid system described supports tiles, which are supported on the lower support. If this is in the form of an invert T-profile, the tiles are supported on the flange of the lower support. In other cases there is generally a substantially horizontal flange which can be used to support the tiles.

The tiles may be conventional and for instance may be made of fibre materials such as mineral fibres (e.g. glass, stone or slag wool). Other types can be used.

Once the tiles are in position, it is often necessary to provide means for keeping appropriate spacing between them. This is commonly done by means of a stop clip. Conventional stop clips can be used in the invention, but it is preferred to use a novel stop clip.

According to this aspect of the invention we provide a novel stop clip provided from a single plate which has an upper section adapted to hook over a support which has a substantially vertical web, and a planar lower section connected to the upper section, and extending perpendicularly from the planar lower section is a spacing means having a predefined width.

Preferably extending from the lower section in the opposite direction to the spacing means, also perpendicularly to the plane of the lower section, are hooks which are capable of registering with apertures in a support profile.

Preferably the stop clip is formed by folding from a single planar sheet of material, preferably spring steel. This sheet can be punched out from a larger sheet.

BRIEF DESCRIPTION OF THE FIGURES

FIGS. 10*a*, 10*b* and 10*c* show a variant of the mounting clip shown in FIG. 1. FIG. 10*b* is the view of the section of 10*a* in the plane marked A-A.

DETAILED DESCRIPTION OF THE FIGURES

Figure 1:
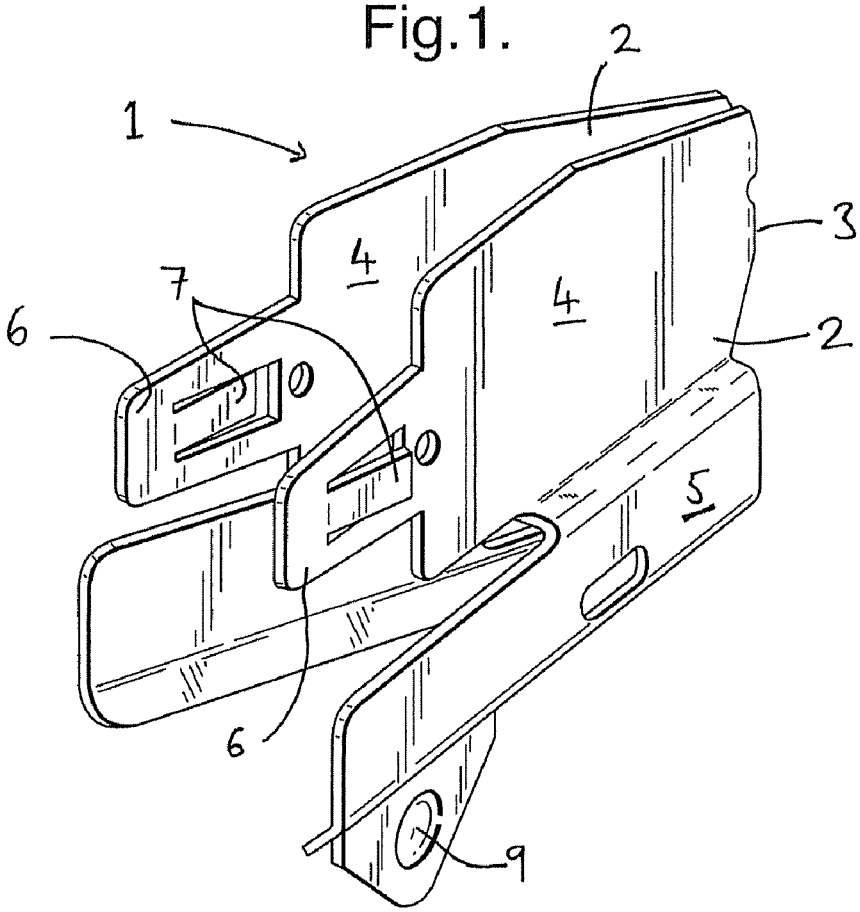
FIG. 1 shows a perspective view of a mounting clip for use in the system of the invention.

FIG. 1 shows a mounting clip 1 as produced and ready for use in the system of the invention. It has plates 2 joined by a fold 3 which connects the upper sections 4 of the two plates. The lower sections 5 of the plate are not joined. Each upper section has a protruding section 6 having a barb 7.

Figure 2:
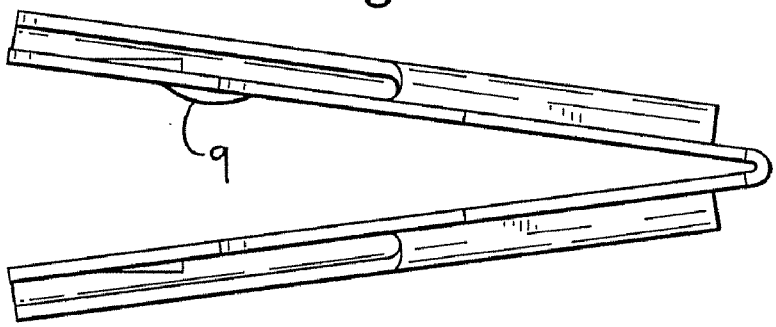
FIG. 2 shows the same mounting clip from above.

At the lower edge of the lower section there is a substantially triangular extension having a projection 9, more clearly visible in FIG. 2. This extension has a length about one third of the length of the lower section 5 of the plate.

FIGS. 3*a* to 3*e* show how the mounting clip is used to connect the upper and lower supports.

Figure 3A:
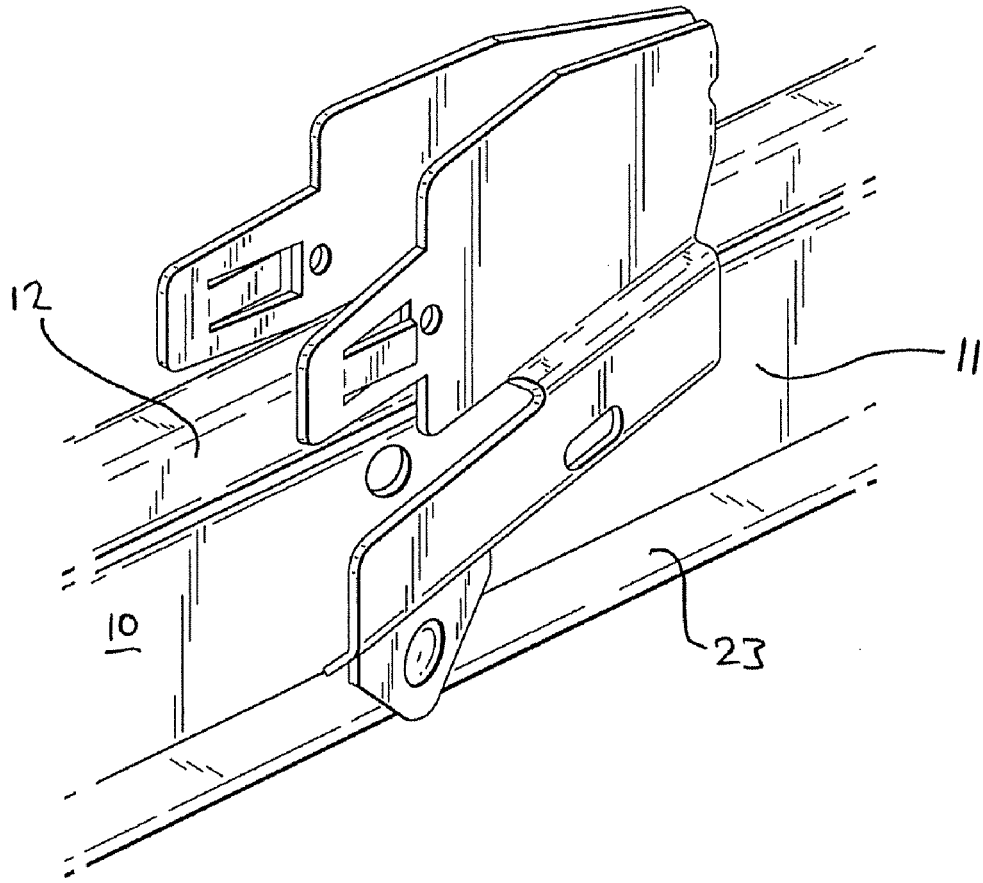
FIGS. 3*a* to 3*e* show the method by which the upper and lower supports are connected using the mounting clip.

In FIG. 3*a* the mounting clip 1 is placed over the lower support 10, which is in the form of a conventional invert T-profile, having a substantially vertical web 11 and substantially horizontal flanges 23. The top half of the substantially vertical web is in the form of a bulb 12.

The mounting clip is positioned so that the lower sections of the two plates are on opposite sides of the vertical web of the T-profile 10.

Figure 3B:
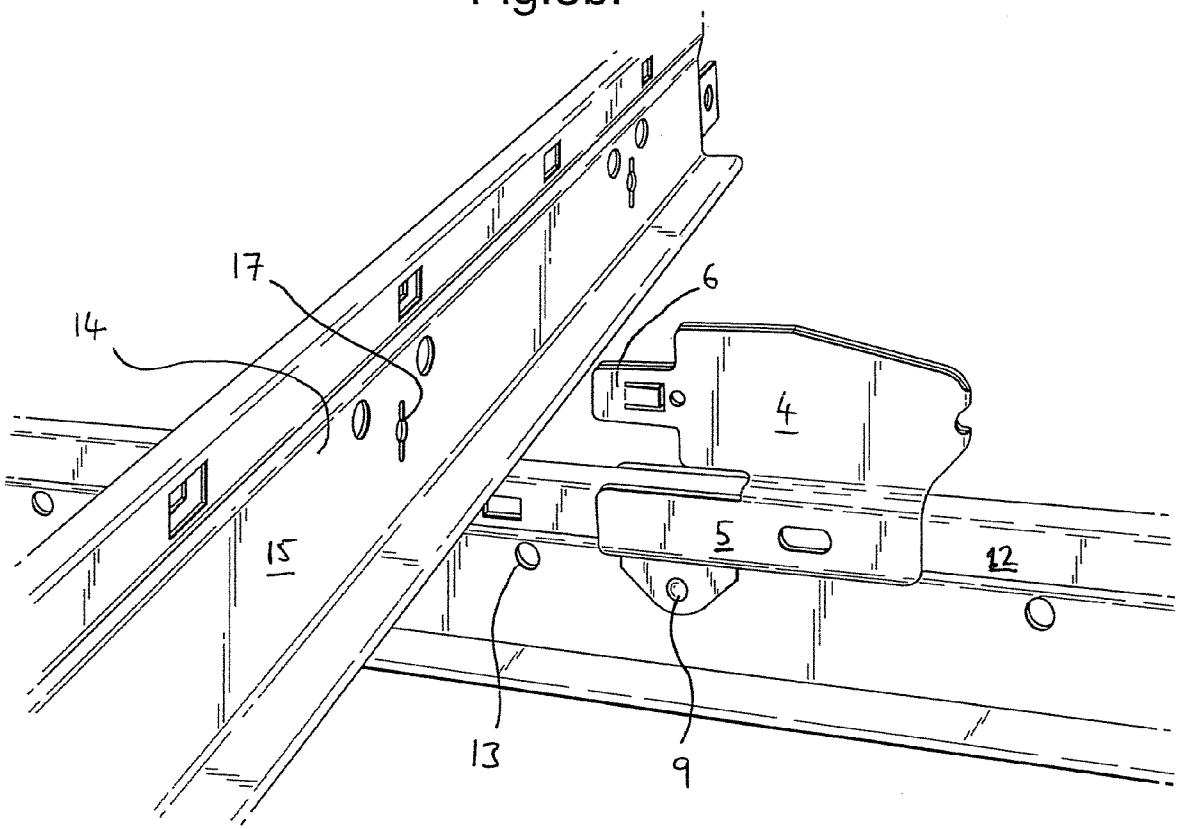

As shown in FIG. 3*b* the projections 9 are aligned with and registered with apertures 13 in the web 11 of the T-profile 10. The clip is then closed to force the upper sections 4 together and the lower sections 5 against the bulb 12. The protruding sections 6 are then flush with one another.

It can be seen that the lower section of each plate is shaped so as to correspond with the shape of the bulb 12 and be flush with it when the upper sections are flush with one another.

The upper support is then positioned substantially perpendicular to the lower support and above it and is slid along it towards the mounting clip so that the protruding sections 6 pass through the slot 17 in the vertical web 15 of the upper support 14, which is also in the form of a T-profile.

Figure 3C:
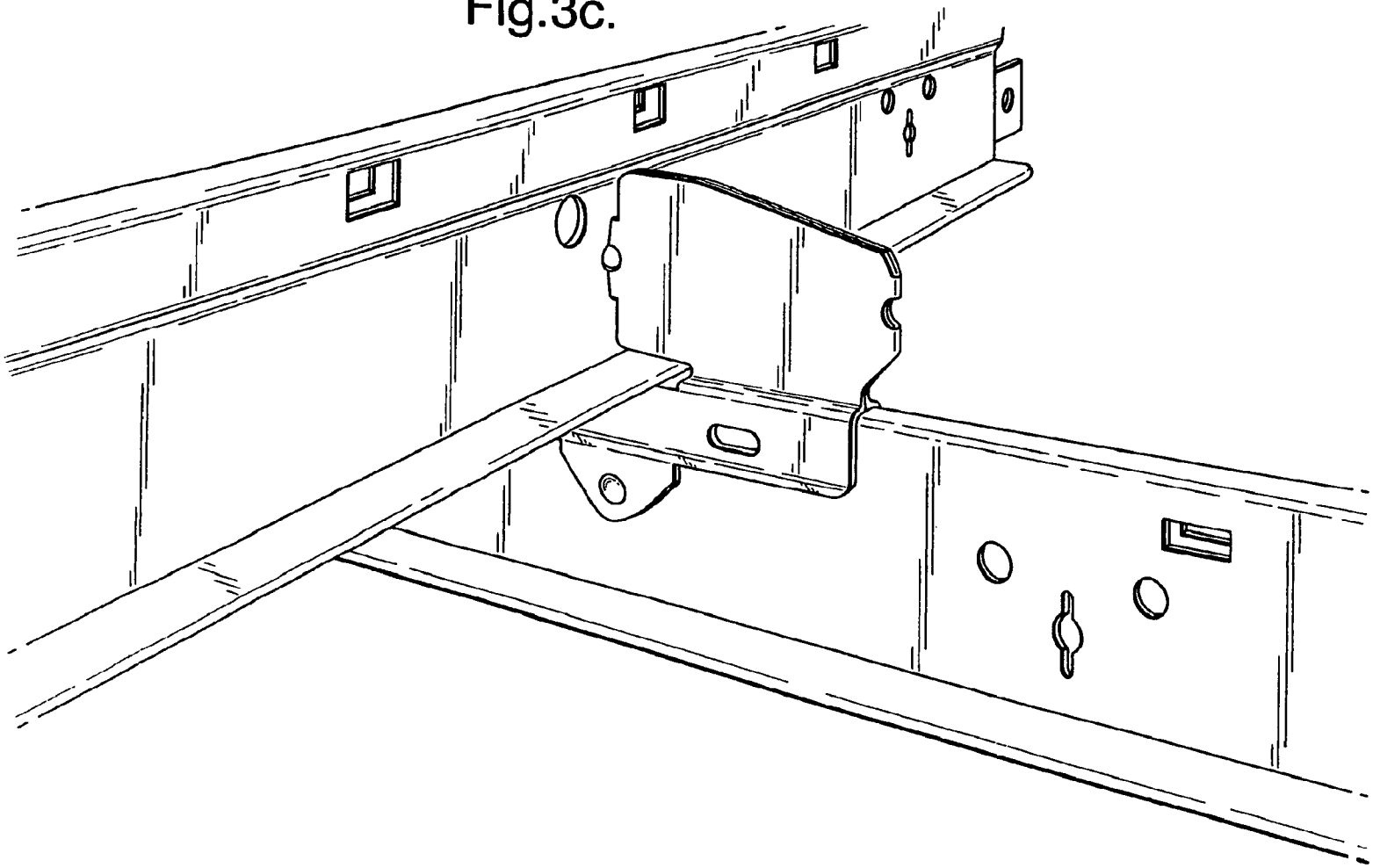

FIG. 3*c* shows the two supports in their final position. It can be seen that once the protruding sections 6 are forced together and held together by the slot 17, it is not possible for the lower sections to come away from the lower support.

Figure 3D:
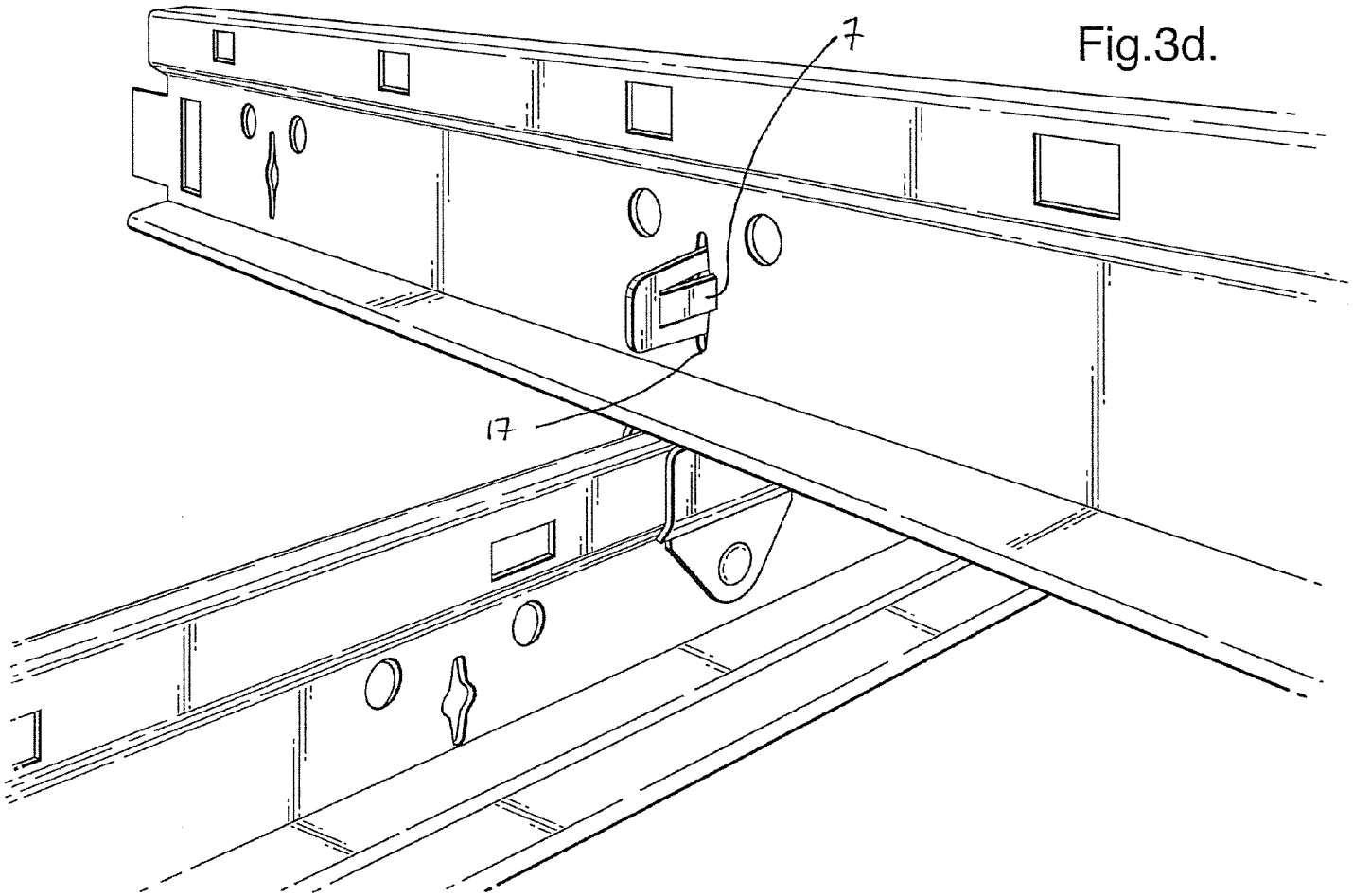

FIG. 3*d* shows the same arrangement from the upper side of the upper support. This shows the barbs 7 which prevent the protruding sections 6 from exiting the slot 17.

Figure 3E:
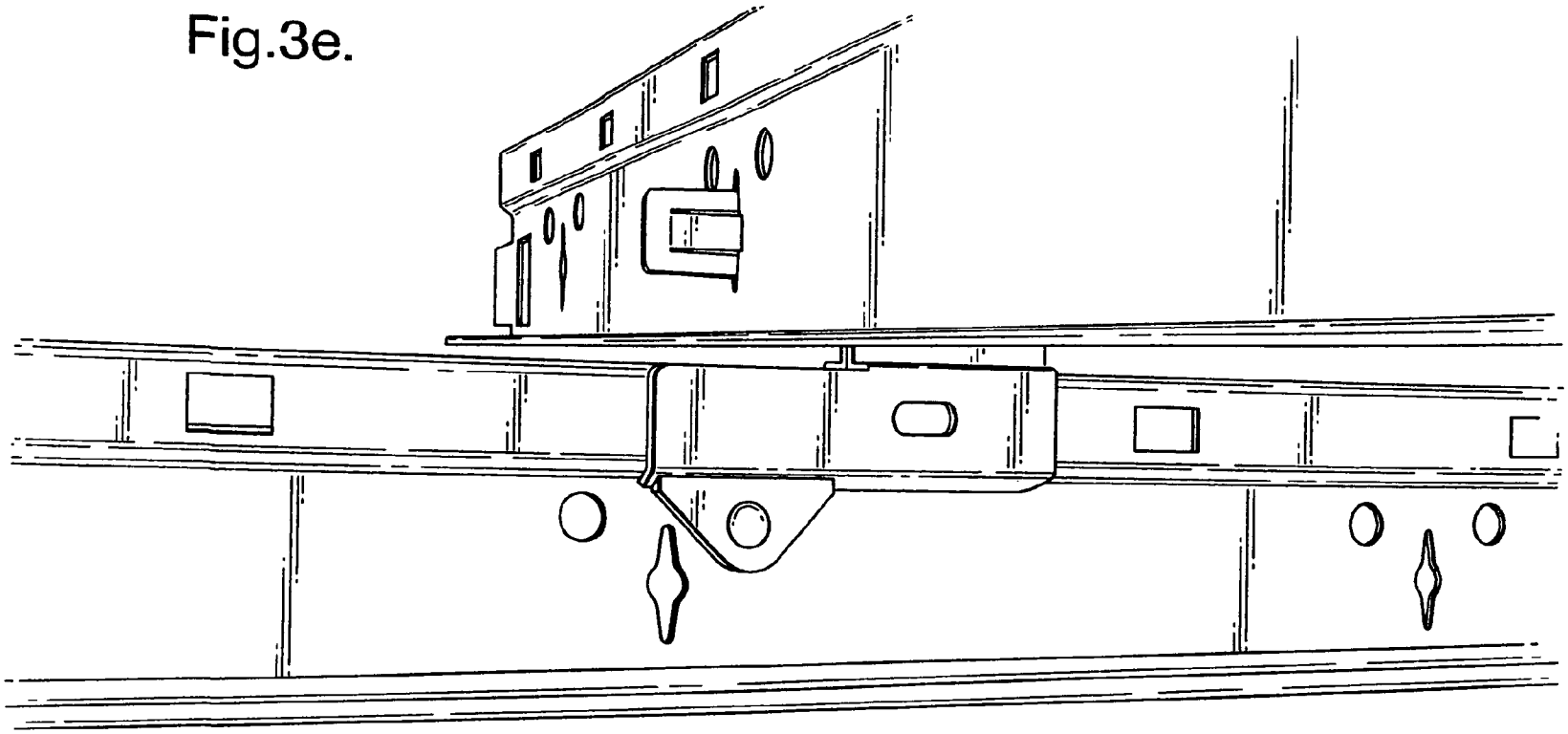

As can be seen from FIG. 3*e*, the lower sections of the plate extend underneath the upper profile and along the lower profile.

Figure 4:
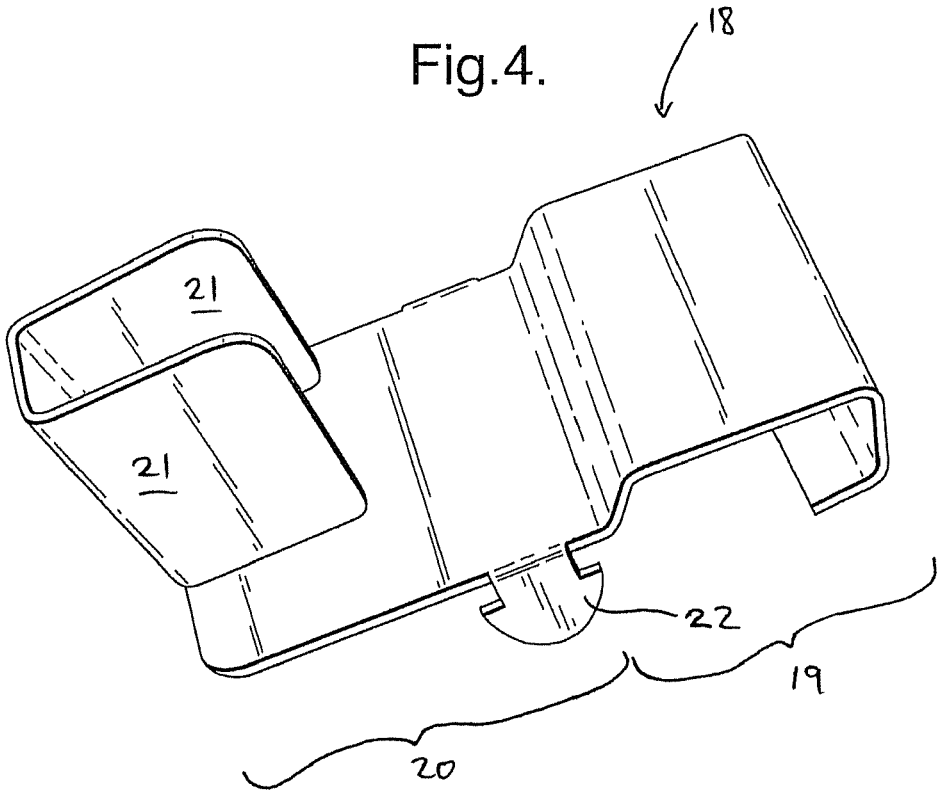
FIG. 4 shows a novel stop clip for use in the system of the invention.

FIG. 4 shows a preferred stop clip for use in the system of the invention.

In this embodiment the stop clip 18 is formed from a single sheet of spring steel. The upper section 19 is folded so as to be capable of hooking onto the bulb 12 of the lower T-profile 10.

The lower section 20 is provided with a perpendicularly extending barrier which maintains spaces between adjacent ceiling tiles. This is formed from a substantially U-shaped section, whereby there are two substantially planar and parallel stop plates 21 both perpendicular to the planar surface of the lower section.

Figure 5:
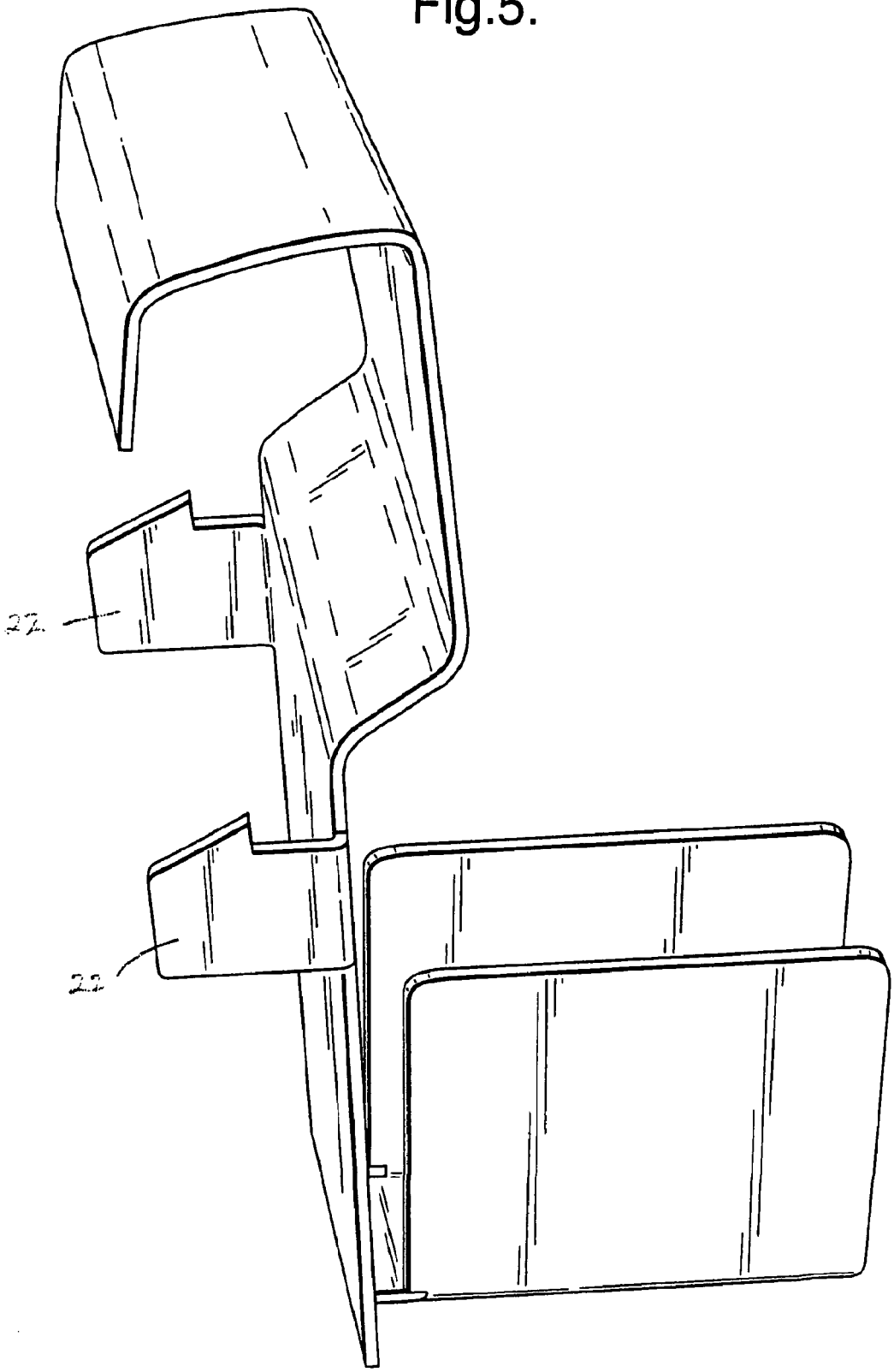
FIG. 5 shows a side view of the same stop clip.
Figure 6:
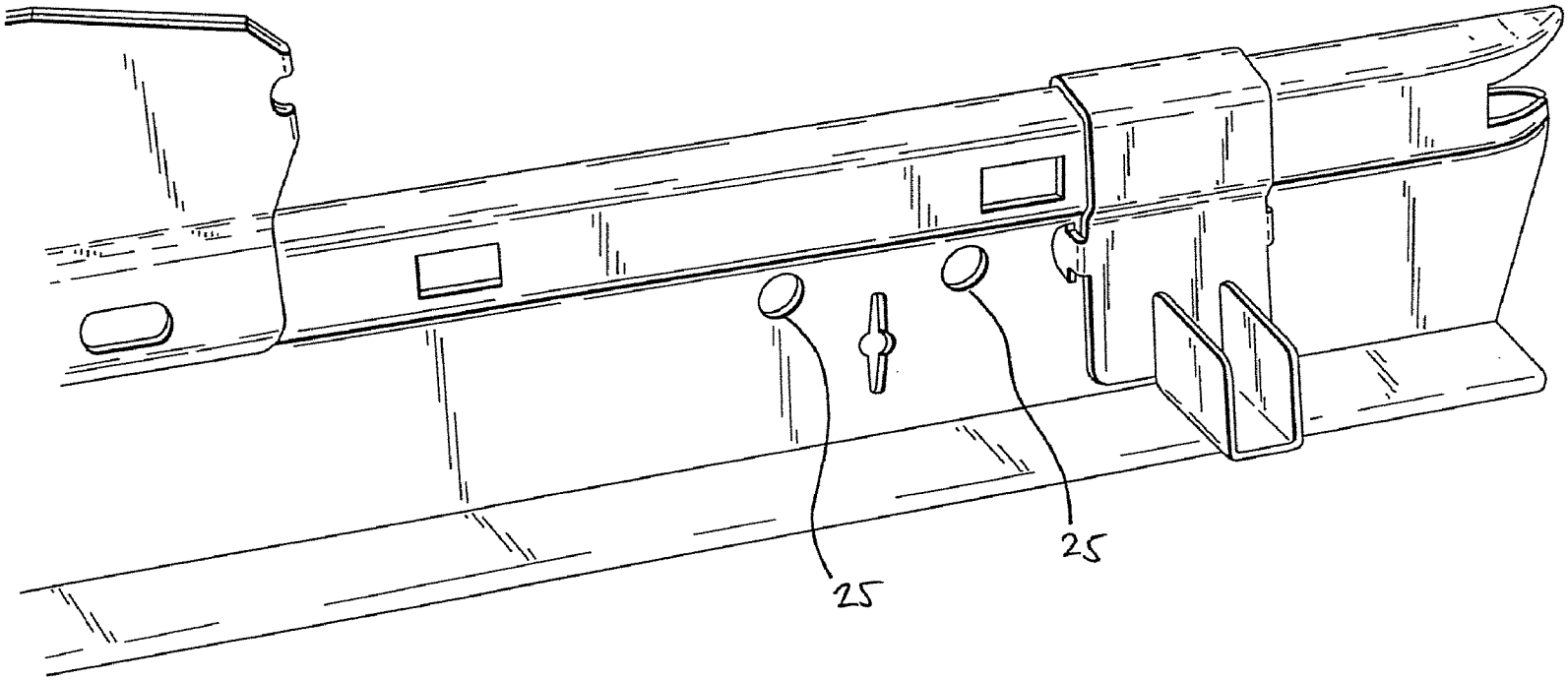
FIG. 6 shows the stop clip connected to a lower support from one side.
Figure 7:
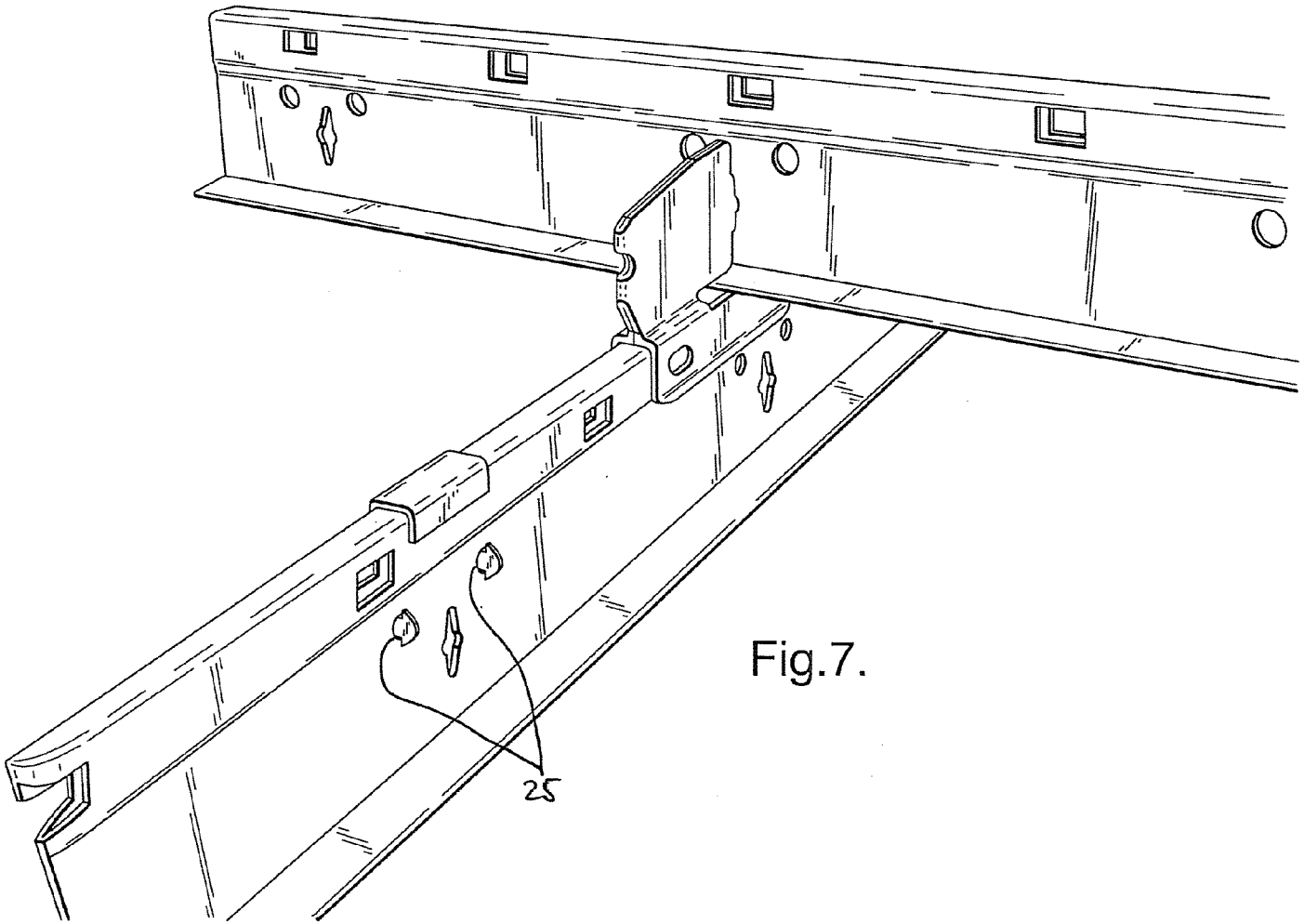
FIG. 7 shows the same stop clip connected to a lower support from the other side.

In this lower section 20 there are also hooks 22 which extend from the lower section at a higher position than the stop plates 21 and in the opposite direction. These are shown more clearly in FIG. 5. As can be seen from FIG. 6 and FIG. 7, these hooks register with apertures 25 in the vertical web 11 of the lower T-profile 10 and ensure that the stop clip remains in position and cannot be separated from the lower T-profile or move along it.

Figure 8:
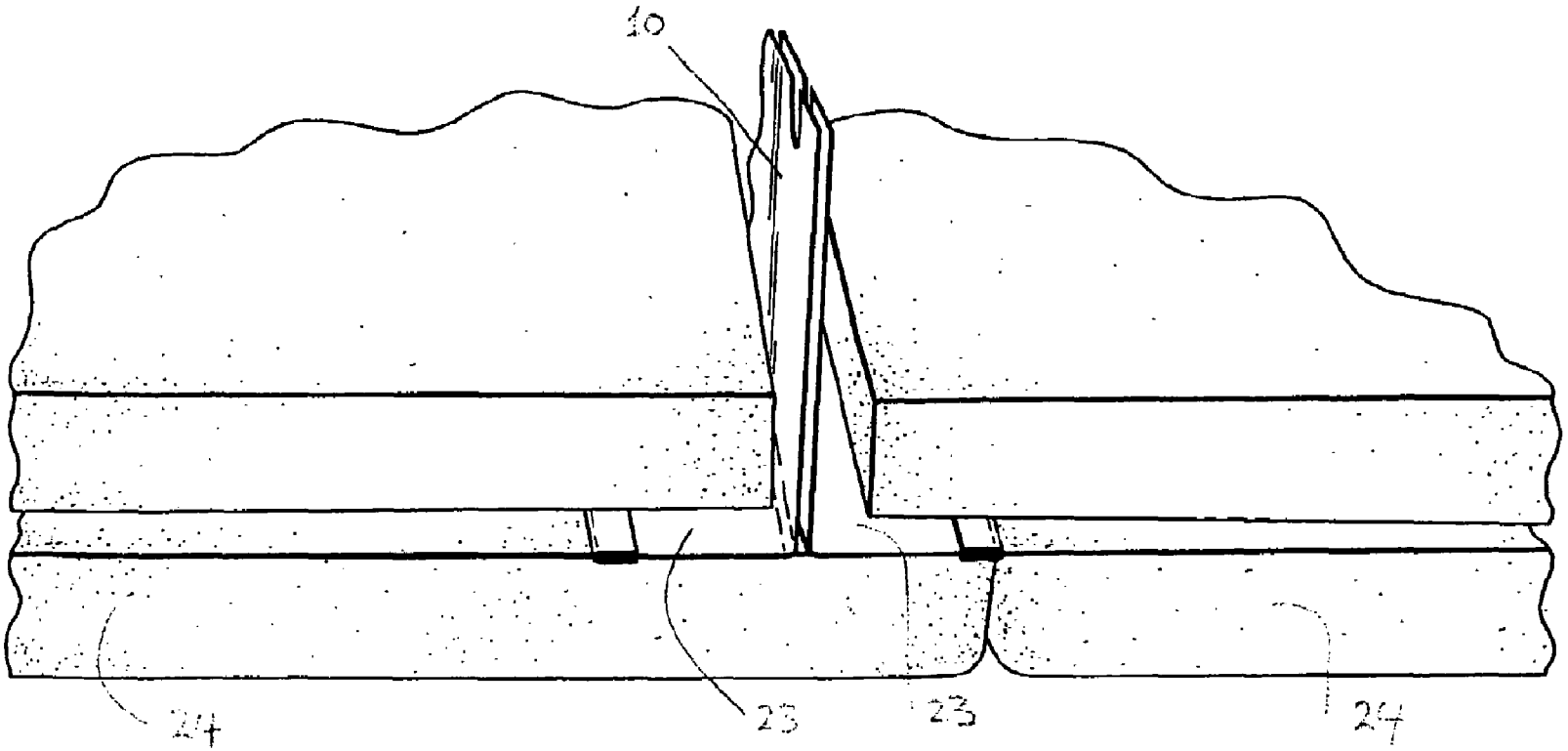
FIG. 8 shows two ceiling tiles as they are supported by a lower support.

FIG. 8 shows two ceiling tiles 24 supported on the flanges 23 of the lower T-profile 10. The ceiling tiles have a step profile so that the lower halves of each tile can be flush with one another so as to conceal the support grid, as is conventional in concealed ceilings.

Figure 9:
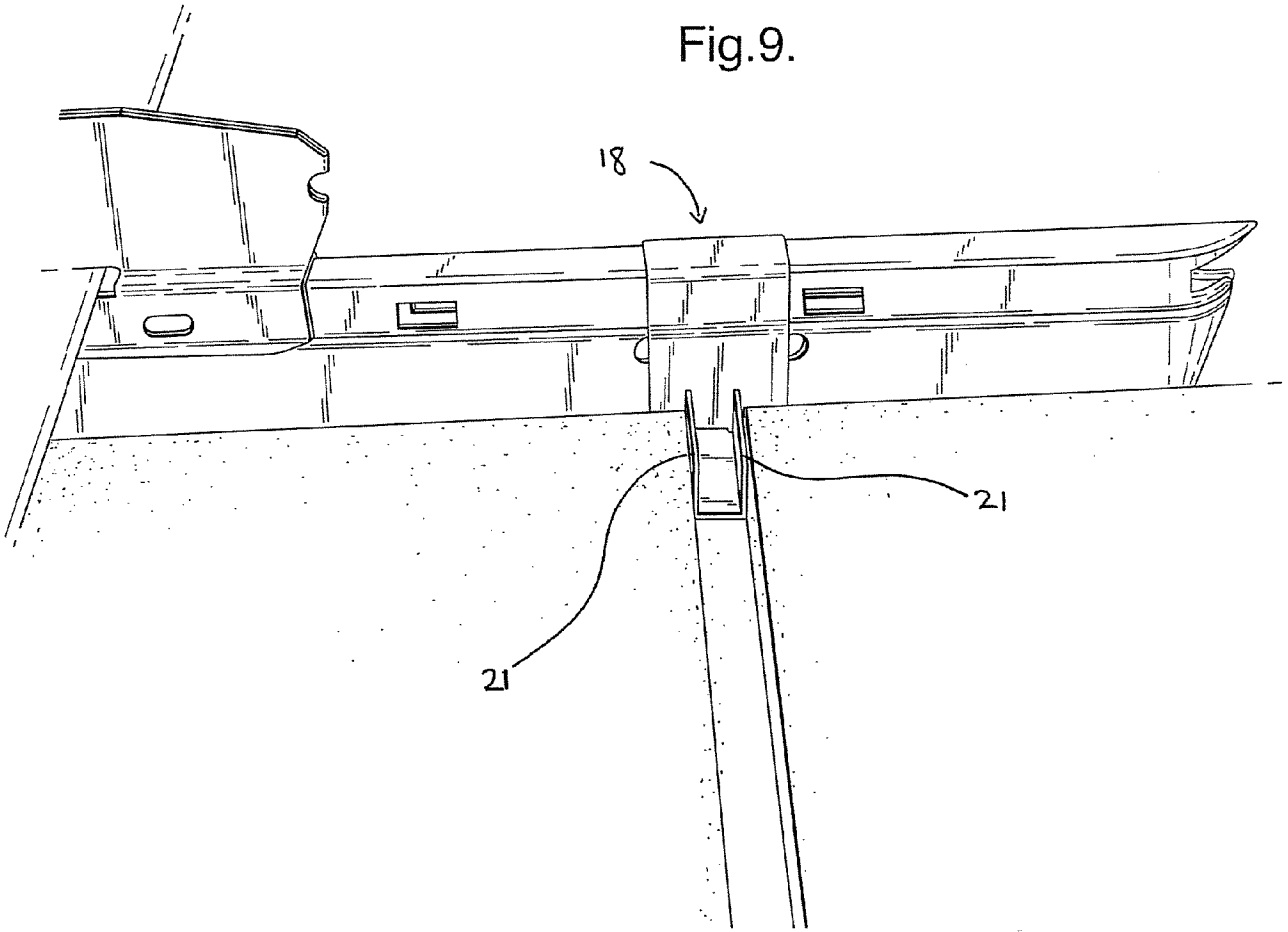
FIG. 9 shows a stop clip in position on a lower support acting as a spacer between two adjacent ceiling tiles.

Periodically along the length of the lower T-profile 10 there is positioned a stop clip 18, as shown in FIG. 9. This provides a barrier between adjacent tiles. The tiles abut the stop plates 21.

Figure 10C:
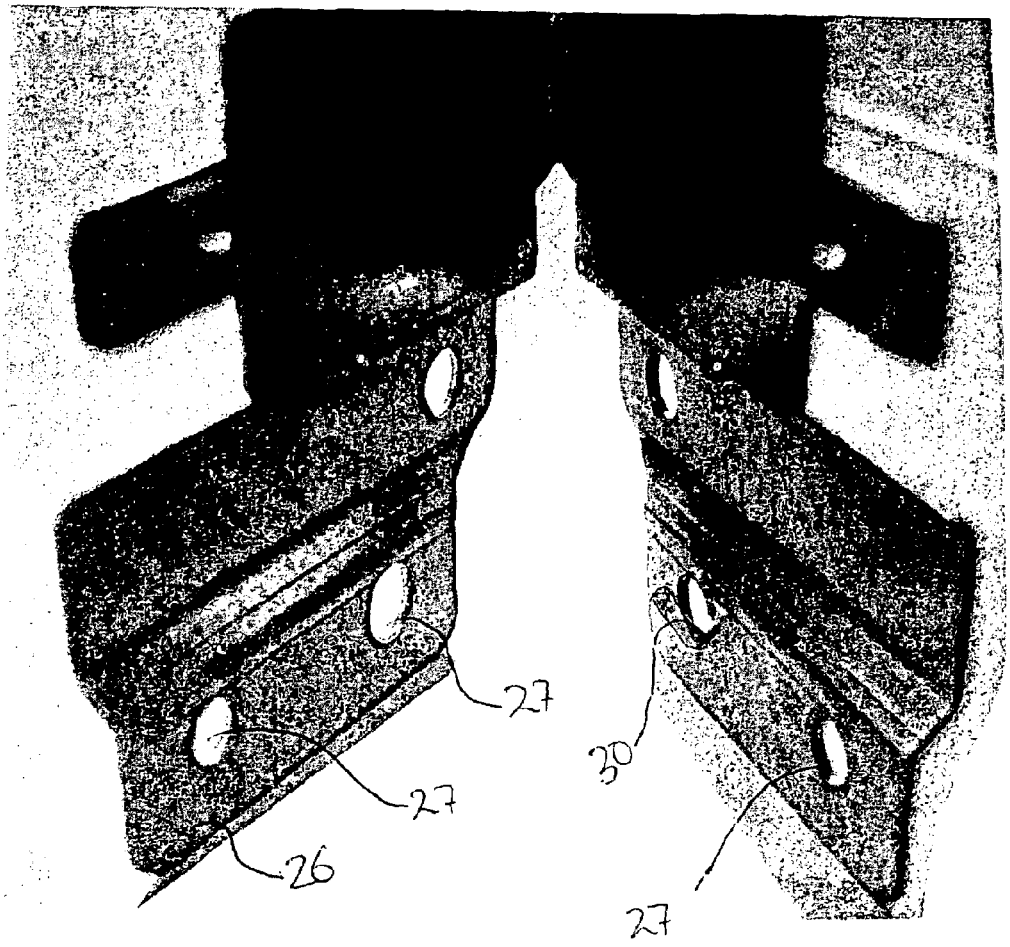

FIGS. 10*a*, 10*b* and 10*c* show a variant of the mounting clip illustrated in FIG. 1. In this variant there is, forming the lower part of the lower section, an extension 26 formed as two adjoining substantially rectangular projections 29 in FIG. 10*a* or a single extension 26 as shown in FIG. 10*c*. This extension 26 is normally present in this variant on each of the two lower sections. This extension or lower part 26 has a length around three quarters of the length of the upper part of the lower section.

It can be seen that within the extension 26 there are two formations. These can be apertures or hooks. In the most preferred embodiment as shown in FIGS. 10*a*, 10*b*, and 10*c*, on one of the extensions 26 there is an aperture 27 within the extension 26 towards the end distal from the fold and a hook 30 within the extension 26 which is proximal to the fold. On the other extension 26 there are two apertures 27.

The hook 30 extends out of the plane of the lower part of the lower section towards the other plate. The shape of the hook 30 is shown more clearly in FIG. 10*b* which is a cross-section view through line A-A in FIG. 10*b*. The hook 30 can also be clearly seen in FIG. 10*c*.

When the mounting clip is in position, as shown above in FIG. 3, the aperture 27 and hook 30 register with corresponding apertures in the web of the lower support. Where aperture 27 registers with a corresponding aperture of the web, the mounting clip can be secured in position by inserting a fastener through the apertures.

Where the hook 30 registers with a corresponding aperture of the web, it extends into the aperture. The hook 30 can be used in this way to ensure that the correct distance is maintained between T-profiles. The hook also provides additional security to the system.

The aperture 28 in the upper part of the lower section 5 of the plate also registers with a corresponding aperture in the bulb of the lower support and a fastener can be threaded through these two apertures and a corresponding aperture in the other lower section 5 of the plate so as to provide additional stability.

Figure 11A:
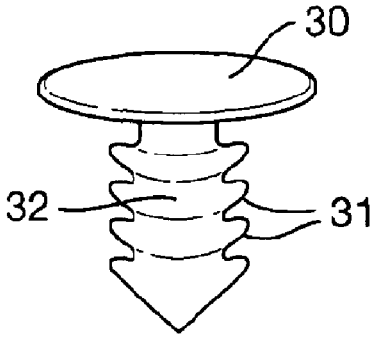
FIGS. 11*a* to 11*c* show examples of fasteners.
Figure 11B:
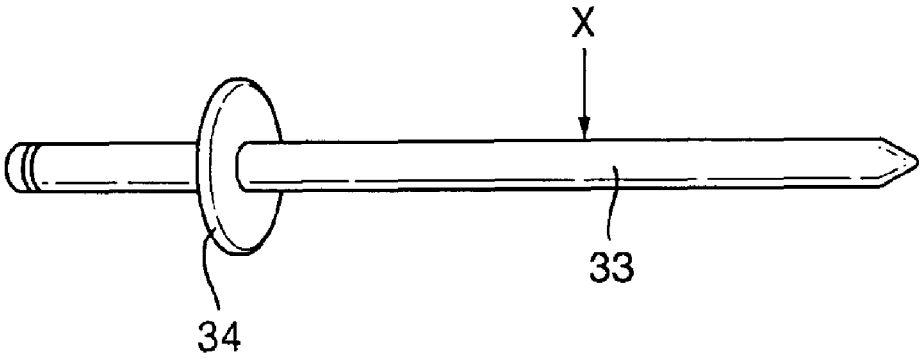
Figure 11C:
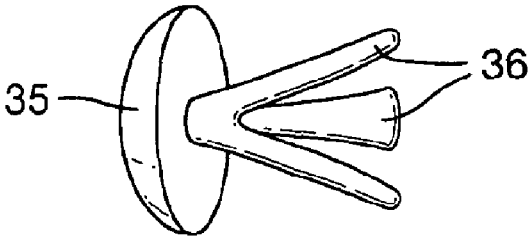
Figure 12:
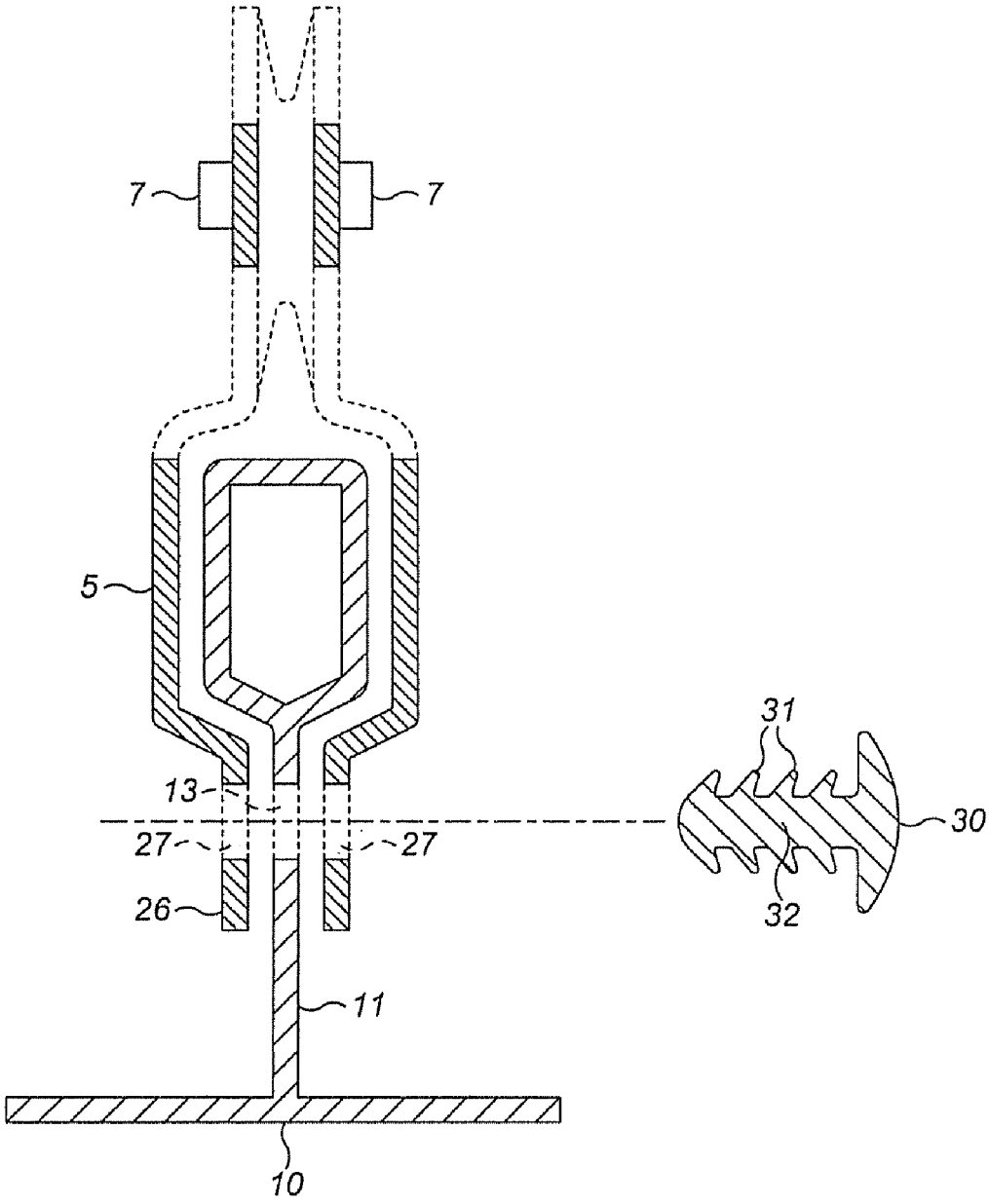
FIG. 12 shows a mounting clip as shown in FIG. 10*a*, installed on the T-profile 10 shown for example in FIG. 3*b*, using a fastener 30 as shown in FIG. 11*a*.

FIGS. 11*a*, 11*b* and 11*c* demonstrate three types of fastener which can be used in the invention.

The fastener in FIG. 11*a* having a head 30 and a shaft 32 is inserted through the relevant apertures and is held in position by the barbs 31 on the shaft 32.

An alternative fastener is shown in FIG. 11*b* and has a head 34 and a shaft 33. This is particularly suitable for threading through apertures in the upper part of the lower section and through the bulb of the lower support. This fastener can be threaded through the apertures and then bent at point X so as to secure it in position.

The fastener shown in FIG. 11*c*, likewise, has a head 35 and prongs 36 is threaded through the relevant apertures and then the prongs 36 can be bent back, usually with the use of a tool, so as to secure it in position.

The invention claimed is:

1. A system for suspending ceiling tiles, comprising
- a plurality of substantially parallel upper supports,
- a plurality of substantially parallel lower supports which are substantially perpendicular to the upper supports and which cross the upper supports at crossing points,
- each of the upper supports having more than one aperture and configured to be suspended from a building ceiling,
- a mounting clip which affixes each lower support to an upper support at a crossing point,
- the lower supports each having a substantially vertical web,
- wherein the mounting clip has the form of two plates each having an upper section and a lower section and the upper section of each plate has a protruding section at one edge, and each of the protruding sections passes through a same one of said more than one aperture in the upper support,
- whereby the lower sections of the two plates pass on opposite sides of the vertical web of the lower support and press against and grip the lower support as a result of each of the protruding sections being held within the same one of said more than one aperture in the upper support.

2. A system according to claim 1 in which all upper supports are alike and all lower supports are alike.

3. A system according to claim 2 in which both upper and lower supports are in the form of an invert T-profile.

4. A system according to claim 1, in which the more than one aperture in the upper supports is more than one substantially vertical slot.

5. A system according to claim 1 in which the two protruding sections are in contact with one another.

6. A system according to claim 1 in which the upper sections of the two plates are held in contact with one another as a result of each of the protruding sections being held within the same one of said more than one aperture in the upper support.

7. A system according to claim 1 in which the protruding sections from the upper section of the plates have barbs which prevent these sections from passing out of the more than one aperture in the upper support once fitted into it.

8. A system according to claim 1 in which the two plates form part of a unitary mounting clip having a single fold between the plates.

9. A system according to claim 8 in which the mounting clip is symmetrical about the fold.

10. A system according to claim 8, wherein the fold joins the upper sections of the plates, and the plates are not joined along the edges of the lower section, so that one plate rests against each side of the substantially vertical upper web of the lower support.

11. A system according to claim 8 wherein the two plates are joined at the side edges opposite the protrusions which pass through the same one of said more than one aperture in the upper support.

12. A system according to claim 1 in which at the lower edge of the lower section of the plates there are projections which are arranged so as to project towards the vertical web of the lower support and to register with apertures in a lower part of the vertical web of the lower support.

13. A system according to claim 1 in which there are one or more hooks in the lower section of at least one of the two plates which register with a corresponding aperture in the vertical web of the lower support.

14. A system according to claim 1 in which there are one or more apertures in the lower section of at least one of the two plates which register with a corresponding aperture in the vertical web of the lower support.

15. A system according to claim 14 in which the mounting clip and the lower support are configured to be maintained in their relative positions by a fastener passed through one of said one or more apertures in the lower section of a plate and said corresponding aperture in the vertical web of the lower support.

16. A system according to claim 1 in which there is one aperture and one hook in the lower section of at least one of the two plates which register with corresponding apertures in the vertical web of the lower support.

17. A system according to claim 1 additionally comprising a plurality of tiles positioned on the lower supports.

18. A system according to claim 17 additionally comprising a stop clip configured to be positioned between adjacent tiles.

19. A system according to claim 1, wherein said protruding sections protrude in the plane of the respective plates.

20. A system according to claim 1, wherein the lower sections of the plates are substantially parallel with the vertical web of the lower support.

21. A method of mounting a grid for a suspended ceiling, comprising
- (1) providing
  - (A) an upper support which has a substantially vertical web containing an aperture and which is suspended from the building ceiling,
  - (B) a lower support having a substantially vertical web,
  - (C) a mounting clip having two plates, each plate having an upper section and a lower section, each upper section having at one side edge a protruding section,
- (2) placing the mounting clip over the lower support such that the lower sections of each plate are on opposite sides of the substantially vertical web of the lower support,
- (3) bringing the upper sections of the plates toward one another, and contacting the lower sections of the plates with the vertical web of the lower profile, (4) bringing each protruding section through said aperture provided in the vertical web of the upper support, so as to affix the lower and upper supports together in mutually perpendicular relationship.

22. A system for suspending ceiling tiles, comprising a plurality of substantially parallel upper supports, a plurality of substantially parallel lower supports which are substantially perpendicular to the upper supports and which cross the upper supports at crossing points, the upper supports having apertures and configured to be suspended from a building ceiling, a mounting clip which affixes each lower support to an upper support at a crossing point, the lower supports each having a substantially vertical web, wherein the mounting clip has the form of two plates each having an upper section and a lower section and the upper section of each plate has a protruding section at one edge, and the two protruding sections each pass through a same one of said apertures in the upper support, whereby the lower sections of the two plates pass on opposite sides of the vertical web of the lower support and press against and grip the lower support as a result of the protruding sections being held within said same one of said apertures in the upper support, wherein the two plates form part of a unitary mounting clip and have a single fold between the plates, wherein the fold is substantially vertical.

* * * * *